United States Patent [19]

Whynott

[11] Patent Number: 4,967,634

[45] Date of Patent: Nov. 6, 1990

[54] MARCHING DRUM AND SNARE MECHANISM

[76] Inventor: Christopher J. Whynott, 673 Palmateer Drive, Kincardine, Ontario, Canada, N2Z 1R5

[21] Appl. No.: 387,829

[22] Filed: Aug. 2, 1989

[51] Int. Cl.[5] ..... G10D 13/02

[52] U.S. Cl. ..... 84/413; 84/411 A; 84/414; 84/415; 84/417

[58] Field of Search ..... 84/411–420

[56] References Cited

U.S. PATENT DOCUMENTS

| | | | |
|---|---|---|---|
| 382,045 | 5/1888 | Lehnert | 84/415 |
| 389,594 | 9/1888 | Plowe | 84/417 |
| 614,694 | 11/1898 | Boulanger | 84/417 X |
| 899,488 | 9/1908 | Hemberger | 84/411 R |
| 2,024,937 | 12/1935 | Ludwig | 84/415 |
| 4,356,756 | 11/1982 | Hartry | 84/418 |

*Primary Examiner*—Lawrence R. Franklin
*Attorney, Agent, or Firm*—R. Craig Armstrong

[57] ABSTRACT

A drum having a top head ring, a top head across the top head ring, a tensioning ring above the top head ring and having a downwardly directed annular flange inward of the top head ring and contacting the top head, and tensioning bolts for adjustable positioning of the tensioning ring with respect to the top head ring is disclosed. There is also a bottom head ring, a bottom head across the bottom head ring, a shell between the top head and the bottom head, and tensioning rods for pulling the bottom head ring towards the tensioning ring to thereby tension the bottom head across the bottom edge of the shell, and at least one snare mechanism positionable under each head, the snare mechanism including snare wires positionable from edge to edge of the heads.

1 Claim, 4 Drawing Sheets

MARCHING DRUM AND SNARE MECHANISM

BACKGROUND OF THE INVENTION

This invention relates to an improved drum and snare mechanism, particularly useful with marching drums.

The basic snare is used on a drum to add volume, sustain and attack as well as tonal adjustment. In the prior art, this is accomplished by stringing numerous gut, wire or tension-type springs across the batter (top) head and/or bottom (snare) head.

In the prior art, for the batter or top head, a snare mechanism consisting essentially of a mount and snares is attached beneath the drum head within the interior of the drum shell. On the bottom head, a similar mechanism is affixed externally to the drum shell. Such a system necessarily uses two differently constructed snare mechanisms.

The prior art internal top head snare mechanism poses particular problems, however. In the prior art, no satisfactory mechanism apparently exists which provides for direct contact between the top head and snare wires across the entire diameter of the top head. This necessarily reduces the effectiveness of the top snare. Also in the prior art, snare tension at the top head can only be adjusted at adjustment points within the interior of the shell. Fine tension adjustments to the snare tension at the top head are thus difficult and time consuming. Due to its bulk and complexity, the prior art internal top snare mechanism adds significantly to the cost and weight of the drum. The complexity of the internal mechanism also makes the drum prone to rattles. Also, lack of precision inherent in the prior art structures makes tuning and achieving uniform sound in a drum corps difficult.

The majority of snare mechanisms in the prior art use a group of 12 to 24 snare wires soldered to a bed. The bed is tensioned in unison from one point via, for example, an adjustment screw. With such mechanisms, individual adjustment of the snare wires, though desirable, is impossible. Adjustments in the height of the snare bed with respect to the drum head is usually made from a single point at each end of the snare bed. Height adjustment of the snare bed is thus lacking in precision. Height and tension adjustments are often required due to wear of components such as snare springs or manufacturing imperfections in components.

In the prior art, drum head tensioning is ordinarily accomplished with hardware mounted to the shell. This hardware inhibits resonance of the shell, and thus defeats the purpose of the shell being used as a sound chamber. If the drum shell were free of hardware, tonal quality, pitch intensity and timber (warmth) would be added to the drum.

SUMMARY OF THE INVENTION

It is an object of the invention to provide an improved drum and snare mechanism.

In accordance with the present invention there is provided a drum having a top head ring, a top head across the top head ring, a tensioning ring above the top head ring and having a downwardly directed annular flange inward of the top head ring and contacting the top head, and means for adjustable positioning of the tensioning ring with respect to the top head ring. There is also a bottom head ring, a bottom head across the bottom head ring, a shell between the top head and the bottom head, means for pulling the bottom head ring towards the tensioning ring to thereby tension the bottom head across the bottom edge of the shell, and at least one snare mechanism positionable under each head, the snare mechanism including snare wires positionable from edge to edge of the heads.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
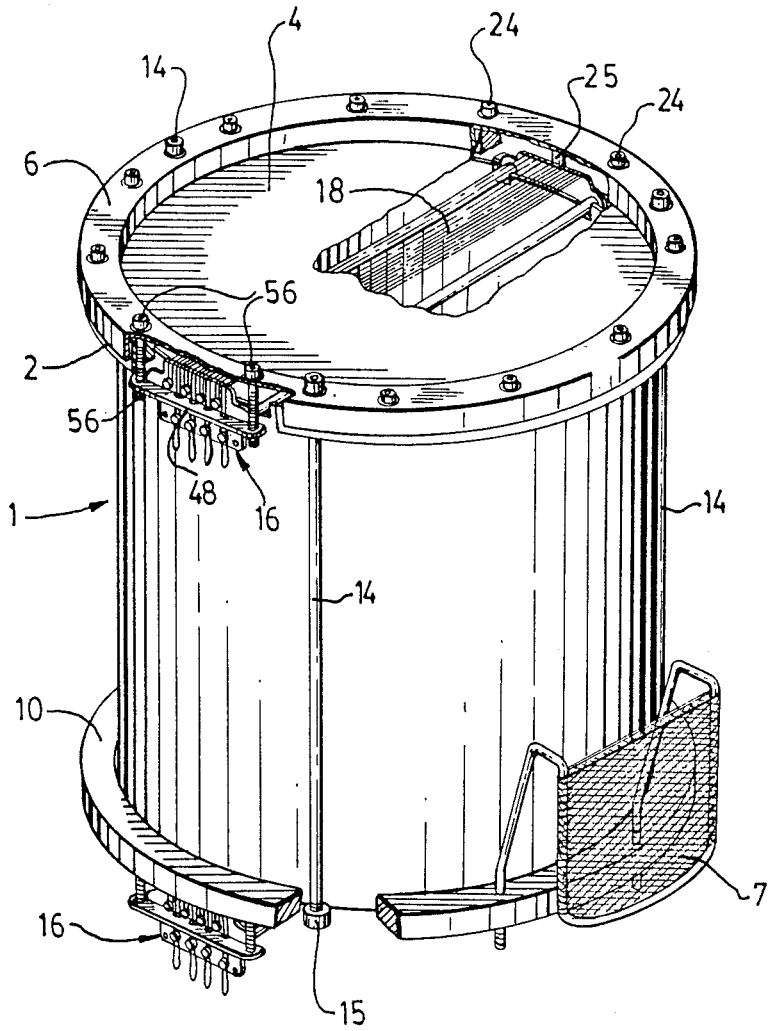
FIG. 1 is a perspective illustration of the drum.

The drum 1 includes a top head ring 2, a top head 4 across the top head ring, a tensioning ring 6, a shell 8, a bottom head ring 10 and bottom head 12. The bottom head ring is pulled towards the tensioning ring by three tensioning rods 14 equally spaced around the circumference of the drum (see FIG. 1). Identical snare mechanisms 16 are mounted as described below, to position the snare wires 18 on the underside of both heads. An attachment bracket 5 for a shoulder sling is provided, along with a leg rest 7.

Figure 4:
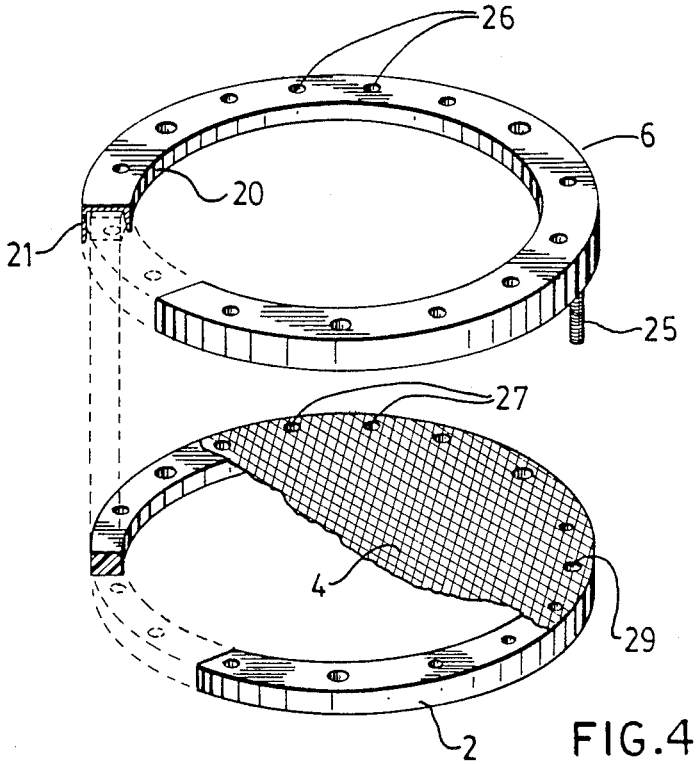
FIG. 4 is a perspective view of the tensioning ring.

The tensioning ring 6, illustrated in FIG. 4, is made from aluminum. It is U-shaped in cross section and thus its underside forms an annular downwardly opening channel with an inner wall 20 and an outer wall 21. The top head ring 2 is preferably made from Fibreglass Reinforced Plastic (FRP), and top head 4 is made, for example, from Kevlar (trademark). The top head 4 is bonded, e.g. by an adhesive, to the upper surface of the top head ring 2.

Figure 2:
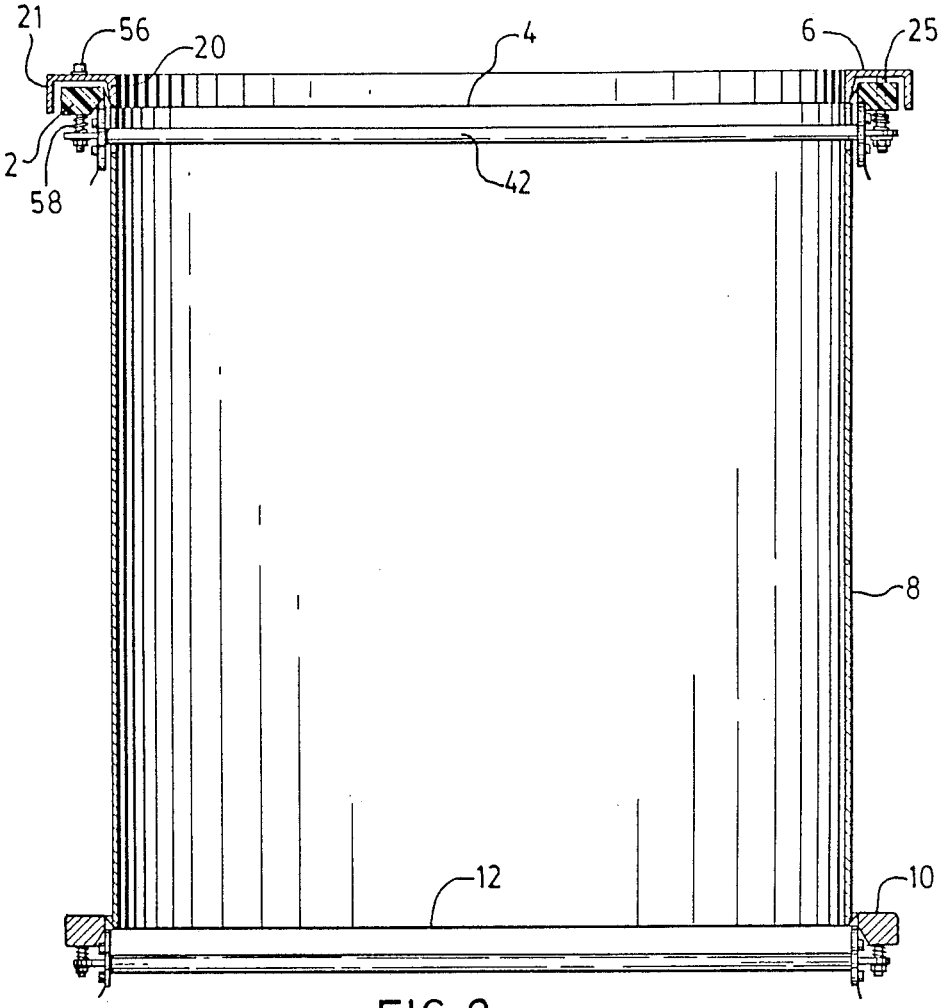
FIG. 2 is a vertical cross-sectional view of the drum taken mechanism.
Figure 2A:
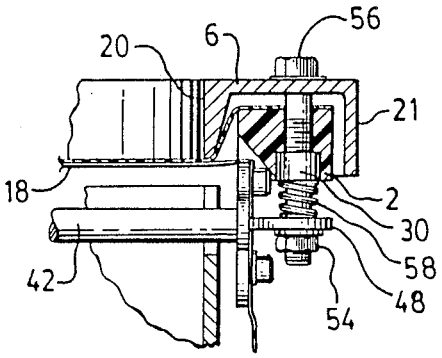
FIG. 2A corresponds to FIG. 2, but shows the area of the top head ring and snare mechanism in greater detail.

As shown in FIGS. 2, 2A and 4, the top head ring 2 lies between the walls 20,21 of the tensioning ring 6. Tensioning bolts 24 pass through holes 26 in the tensioning ring. The head ring 2 has corresponding holes 27 into which threaded Nutserts 30 (trademark) are inserted and glued. The tensioning bolts are threaded into the Nutserts, and thus act to pull the top head ring 2 up into the channel, thus tensioning the top head by drawing it over the inner wall 20.

Two longer tensioning bolts 56 on one side of the drum also serve as snare mount bolts, as shown in FIGS. 1 and 2A. On the opposite side of the drum, as seen best in FIG. 4, a stud 25 is provided, projecting downwardly through a clearance hole 29 in the top head ring from a blind hole in the underside of the tensioning ring 6. The snare mechanism is installed on the bolts 56 and stud 25 in the manner described in greater detail below.

Figure 2B:
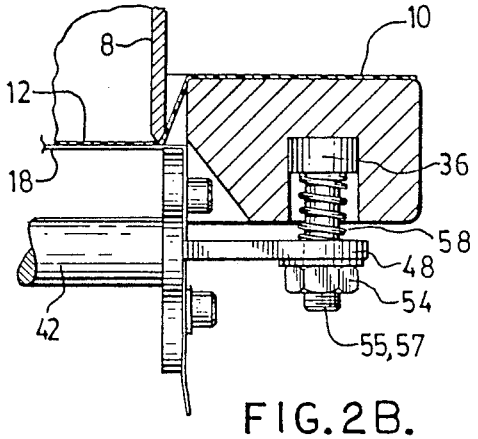
FIG. 2B corresponds to FIG. 2, but shows the area of the bottom head ring and snare mechanism in greater detail.

As seen in FIGS. 2 and 2B, the inner diameter of the bottom head ring 10 is somewhat larger than the external diameter of the shell 8. The bottom head 12, of Mylar (trademark) for example, is bonded to the upper surface of the bottom head ring 10.

The shell 8 rests on the bottom head 12. As mentioned above, the bottom head is tensioned via the three tensioning rods 14. The tensioning rods thread into Nutserts 15 installed in the bottom head ring. The tensioning rods pull the bottom head ring upwardly, thus drawing the bottom head over the bottom edge of the shell. The top edge of the shell butts against the inner wall 20 of the tensioning ring 6 (as seen in FIG. 2A).

Figure 3:
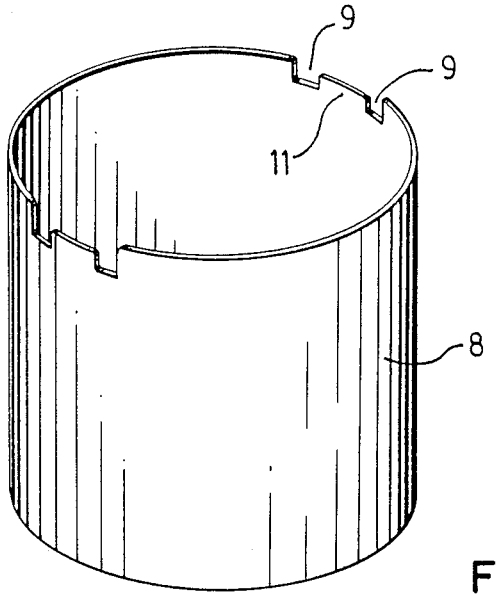
FIG. 3 is a perspective view or the shell.

As can be seen in FIG. 3, the shell 8 has two slots 9 at either side of its top end, to accommodate the stabilizer bars 42 of the snare mechanism. The center tongue 11 of wood between the slots is also reduced in height, to provide clearance for the snare wires.

The shell 8 is made entirely from wood. Since the need for tensioning hardware attached to the shell is avoided by the invention, the entire shell is able to act more effectively as a sound chamber.

Figure 6:
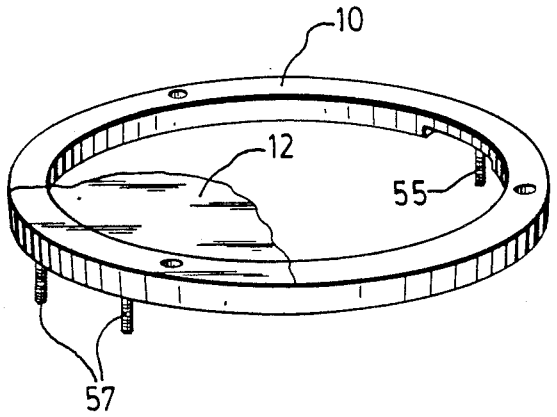
FIG. 6 is a perspective view of the bottom head ring.

As illustrated in FIG. 6, the underside of the bottom head ring 10 has blind holes for two snare mount studs 57 on one side, and a corresponding single stud 55 on the opposite side. The blind holes have Nutserts 36 installed in them, and the studs are threaded up into the Nutserts to bottom out in the holes and project downwardly to receive the snare mechanism.

Figure 5:
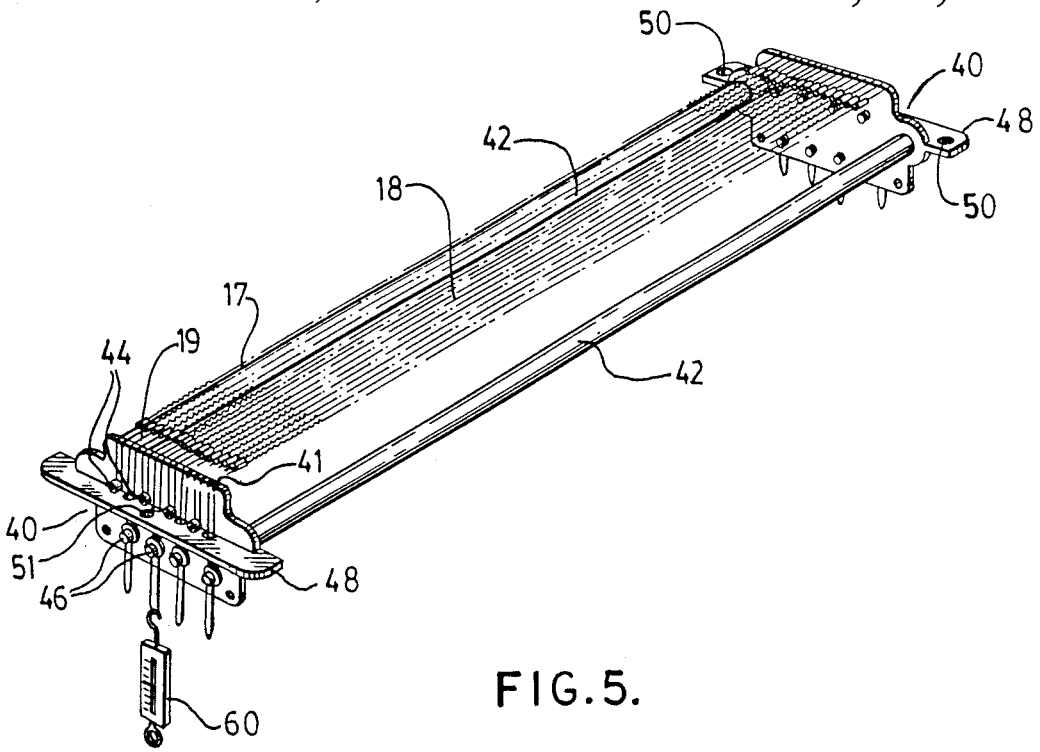
FIG. 5 is a perspective view of the snare mechanism.

As shown in FIG. 5, the snare mechanism includes two opposing snare mounts 40, each with snare wire posts 44, and snare tensioning lock screws and washers 46. There are spacing grooves 41 notched along the uppermost edges of the snare mounts, for spacing the snare wires apart. Two stabilizer bars 42 are welded to the snare mounts to rigidly connect them to each other.

The snare wires 18 consist of eight snare wire loops, making up sixteen snare wires. The central portions 17 of each loop are essentially stretched springs. The end portions 19, which close the loop at each end, are wire.

Each snare wire sits in its spacing groove 41 on the opposing snare mounts 40. One end of each loop is hooked around a snare wire post 44 (four per mount). The other end of the loop passes on both sides of a snare tensioning lock screw and washer 46 (four per mount). If a screw is loosened, a spring-scale 60 can be hooked to the end of the loop, and the tension of each loop can thus be independently set by pulling the loop to the desired tension and tightening the lock screw.

Because the tensioning lock screws are exposed and easily accessible, both top and bottom snare mechanisms 16 are readily and easily adjustable from the exterior of the shell.

Each snare mount 40 has a horizontal mounting flange 48. One of the flanges has two spaced-apart mounting holes 50, and the other has one central mounting hole 51. This three-point suspension allows for optimum adjustment of the snare position, by facilitating both longitudinal and lateral adjustment, as well as overall height. This ensures that the snare wires all are evenly in contact with the head. That is, because one end of the snare mechanism only has one mounting point, slight pivoting about that mounting point is possible, thus allowing greater control over lateral adjustment from the other end where there are two mounting bolts.

As seen best in FIGS. 2A and 2B, the snare mechanism 16 is attached to the top head ring 2 or the bottom head ring 10 by snare mount nuts 54 installed on the respective snare mount bolts or studs. Around each snare mount bolt or stud between the flange 48 and the respective head ring (top 2 o bottom 10) is a spring 58 to locate the snare mechanism against the nuts 54.

The snare mechanisms 16 mounted at either end of the drum head are identical. This allows for flexibility in snare strand needs to suit the players drum-tone needs.

By virtue of the overall configuration of the invention, and the position of the snare mounts, the invention provides for full diameter snare to head contact at both top and bottom of the drum, with excellent flexibility of adjustment both of the snare mechanism position and of the individual snare wire pairs. As seen in FIG. 2A in particular, the snare wires can be positioned parallel to the batter head from edge to edge allowing for the desired better snare response on the top head.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A drum, comprising:

a top head ring;

a top head across said top head ring;

a tensioning ring above said top head ring and having a downwardly directed annular flange inward of said top head ring and contacting said top head;

means for adjustable positioning of said tensioning ring with respect to said top head ring;

a bottom head ring;

a bottom head across said bottom head ring;

a shell between said top head and said bottom head;

means for pulling said bottom head ring towards said tensioning ring to thereby tension said bottom head across the bottom edge of said shell;

and at least one snare mechanism positionable under each head, said snare mechanism including snare wires positionable from edge to edge of said heads.

* * * * *